US006971137B2

(12) United States Patent
Pierce et al.

(10) Patent No.: US 6,971,137 B2
(45) Date of Patent: Dec. 6, 2005

(54) FLOOR MAINTENANCE MACHINE WITH AIR-COOLED MOTOR

(75) Inventors: Paul M. Pierce, Grand Haven, MI (US); Steven J. Waldhauser, Niagara Falls, NY (US)

(73) Assignee: Tennant Company, Minneapolis, MN (US)

( * ) Notice: Subject to any disclaimer, the term of this patent is extended or adjusted under 35 U.S.C. 154(b) by 474 days.

(21) Appl. No.: 10/247,527

(22) Filed: Sep. 19, 2002

(65) Prior Publication Data

US 2003/0066148 A1 Apr. 10, 2003

Related U.S. Application Data

(60) Provisional application No. 60/328,658, filed on Oct. 9, 2001.

(51) Int. Cl.[7] ..... A47L 11/10

(52) U.S. Cl. ..... 15/49.1; 15/98; 451/353; 451/449

(58) Field of Search ..... 15/49.1, 50.1, 15/98, 320, 340.1, 340.2, 340.3, 340.4, 413; 451/449, 359, 357, 353

(56) References Cited

U.S. PATENT DOCUMENTS 1,497,513 A * 6/1924 Kelley ..... 74/606 A
1,739,653 A * 12/1929 Sassano ..... 15/52.1
1,901,497 A * 3/1933 Olof et al. ..... 15/49.1
1,945,425 A * 1/1934 Emmons ..... 451/355
2,000,784 A * 5/1935 Myers ..... 451/355
2,281,858 A * 5/1942 Pierce ..... 15/413
2,287,911 A * 6/1942 Snyder ..... 15/413
2,309,583 A * 1/1943 Frantz ..... 15/344
2,566,809 A * 9/1951 Risley et al. ..... 451/311
3,083,508 A * 4/1963 Fegley et al. ..... 451/356
3,107,378 A * 10/1963 Ivar et al ..... 15/49.1
3,251,085 A * 5/1966 Jacobs ..... 15/23
3,368,231 A * 2/1968 Kravos et al. ..... 15/344
4,435,870 A * 3/1984 Tucker et al. ..... 15/98
4,454,627 A * 6/1984 Simm et al. ..... 15/377
4,542,551 A * 9/1985 Phillips ..... 15/49.1
5,074,006 A * 12/1991 Eremita ..... 15/344
5,664,285 A * 9/1997 Melito et al. ..... 15/352
5,870,791 A * 2/1999 Gurstein et al. ..... 15/98

OTHER PUBLICATIONS

Advance Machine Company "Whirlamatic 20 UHSB Model 393500" brochure, Oct. 1990.
Whirlamatic 20 UHSB photos (4 sheets).

* cited by examiner

*Primary Examiner*—Mark Spisich
(74) *Attorney, Agent, or Firm*—Price, Heneveld, Cooper, DeWitt & Litton

(57) ABSTRACT

A burnishing machine having a burnishing motor in a motor compartment covered with a hood defining an air plenum having at least one air inlet positioned near the top of the hood spaced from the floor. The plenum includes a discharge outlet immediately adjacent the motor such that clean air is drawn through the air inlet, flows through the plenum to the discharge outlet for providing clean air to cool the burnishing motor.

17 Claims, 4 Drawing Sheets

FLOOR MAINTENANCE MACHINE WITH AIR-COOLED MOTOR

CROSS-REFERENCE TO RELATED APPLICATIONS

This application claims priority under 35 U.S.C. § 119(e) on U.S. Provisional Application No. 60/328,658 entitled AIR-COOLED FLOOR MAINTENANCE DRIVER, filed on Oct. 9, 2001, by Paul M. Pierce et al., the entire disclosure of which is incorporated herein by reference.

BACKGROUND OF THE INVENTION

The present invention relates to a floor maintenance machine, such as a burnisher, and particularly to an improved air-cooling system for an electrical drive motor therefor.

Floor maintenance machines and particularly burnishers typically employed for polishing floors in commercial environments employ electrically driven motors which can either be powered by alternating current through a power cord or, with machines which have their own battery supply, are DC powered. Such machines utilize relatively large motors for rotating a burnishing pad which can have a diameter of from about 15" to about 30" running at speeds of from about 1500 to about 3000 rpm. Commercially available electrical motors typically include internal cooling fans and vents for circulating cool air around the motors when in use. Burnishing machines have typically included side vents near the location of the motor adjacent the burnishing pad near the floor for allowing inlet air to be drawn in by the motor's cooling fan to maintain the motor within a safe operating temperature range.

A problem encountered by existing burnishing machines is that the air inlets for cooling the motor are located relatively close to the floor surface being burnished. As a result, dust and debris frequently are drawn into the cooling vents, thereby exposing the motor to such airborne contaminants. The machines then require frequent maintenance to clean the motor area utilizing vacuum cleaners or pressurized air supplies to remove excess dirt and debris from the inlets and/or motor to prevent damage to the motor or clogging of the motor air inlets, which can result in motor overheating and failure. As a result, there exists a need for an improved cooling system for burnishers such that the burnishing motor can be continuously supplied with a clean air stream for cooling and which does not require frequent maintenance.

SUMMARY OF THE INVENTION

The machine of the present invention includes a chassis carrying thereon a drive motor and drive disk for treating floor surfaces. The chassis includes a motor compartment which is covered with a hood defining an air plenum having at least one air inlet at a position remote from the motor near the top of the hood and spaced from the floor. The plenum includes a discharge outlet immediately adjacent the motor such that clean air is drawn through the air inlet, flows through the plenum to the discharge opening for providing clean air to cool the motor. In one embodiment of the invention, a pair of inlet vents are provided in communication with the plenum near the top of the hood.

In the preferred embodiment of the invention, the hood is rotary molded of a polymeric material to define the hollow supply plenum for cooling a burnishing motor. Thus, in a preferred embodiment of the machine of the present invention, a clean air plenum is integrated with a hood for a burnishing machine to supply clean cooling air to the drive motor.

These and other features, objects and advantages of the present invention will become apparent upon reading the following description thereof together with reference to the accompanying drawings.

DETAILED DESCRIPTION OF THE PREFERRED EMBODIMENT

Figures 1, 2:
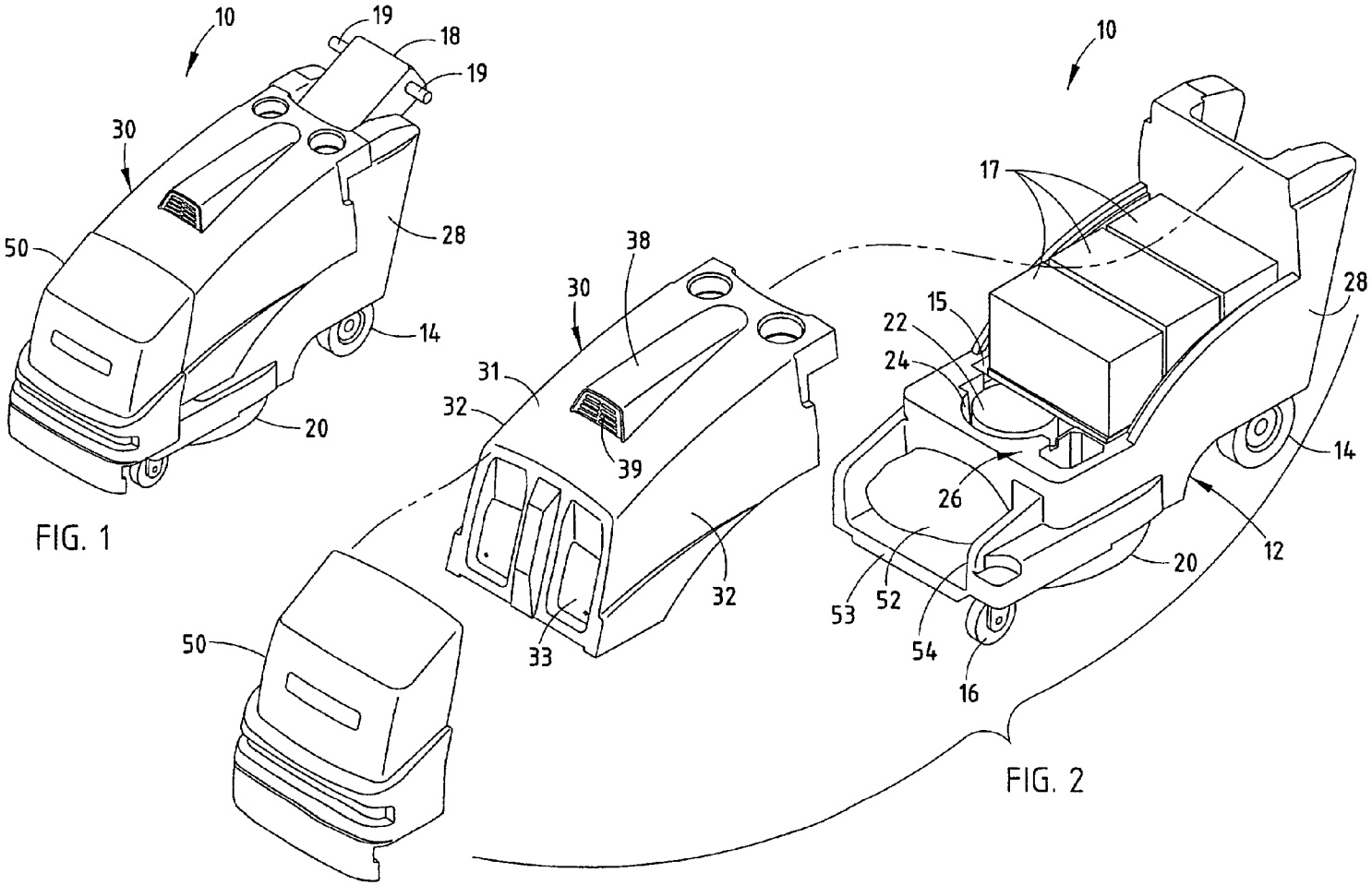
FIG. 1 is a perspective view of a burnishing machine embodying the present invention.
FIG. 2 is an enlarged exploded perspective view of the major components of the burnishing machine shown in FIG. 1.

Referring initially to FIGS. 1 and 2, there is shown a floor treating machine 10 embodying the present invention which, in its preferred embodiment, is a self-powered burnishing machine having a wheeled chassis 12 with pair of rear drive wheels 14 and front caster wheel 16. Machine 10 is controlled by a control console 18 with control handles 19 on either side thereof. Console 18 is tiltable and includes the electrical control switches for actuating the drive motor 22 (FIGS. 2–4) and a burnishing drive disk 20 having a removable burnishing pad which selectively engages a polishable floor surface. This includes a variety of surfaces which are coated with a polishable finish or wax. Machine 10 can likewise be employed for polishing, scrubbing, cleaning, or other general maintenance to the floor surface. The preferred embodiment of the machine 10 is a self-powered unit in which the chassis 12 includes a battery rack 15 (FIG. 2) formed therein for receiving three heavy duty 12 volt batteries 17 for providing operating power to the burnishing motor 22, which is vertically mounted within an annular recess 24 of motor compartment 26 mounted to the chassis 12. The motor compartment and battery rack can be integrally molded of a polymeric material, as seen in FIG. 2, and secured to chassis 12 in a conventional manner. The chassis 12 includes a conventional frame for supporting the drive wheels, drive motor for the wheels, and the mechanism for raising and lowering the drive motor 22 and burnishing drive disk 20. The chassis is enclosed with an outer shroud 28 to provide a streamline appearance mating with hood 30, as seen in FIG. 1.

Figure 3:
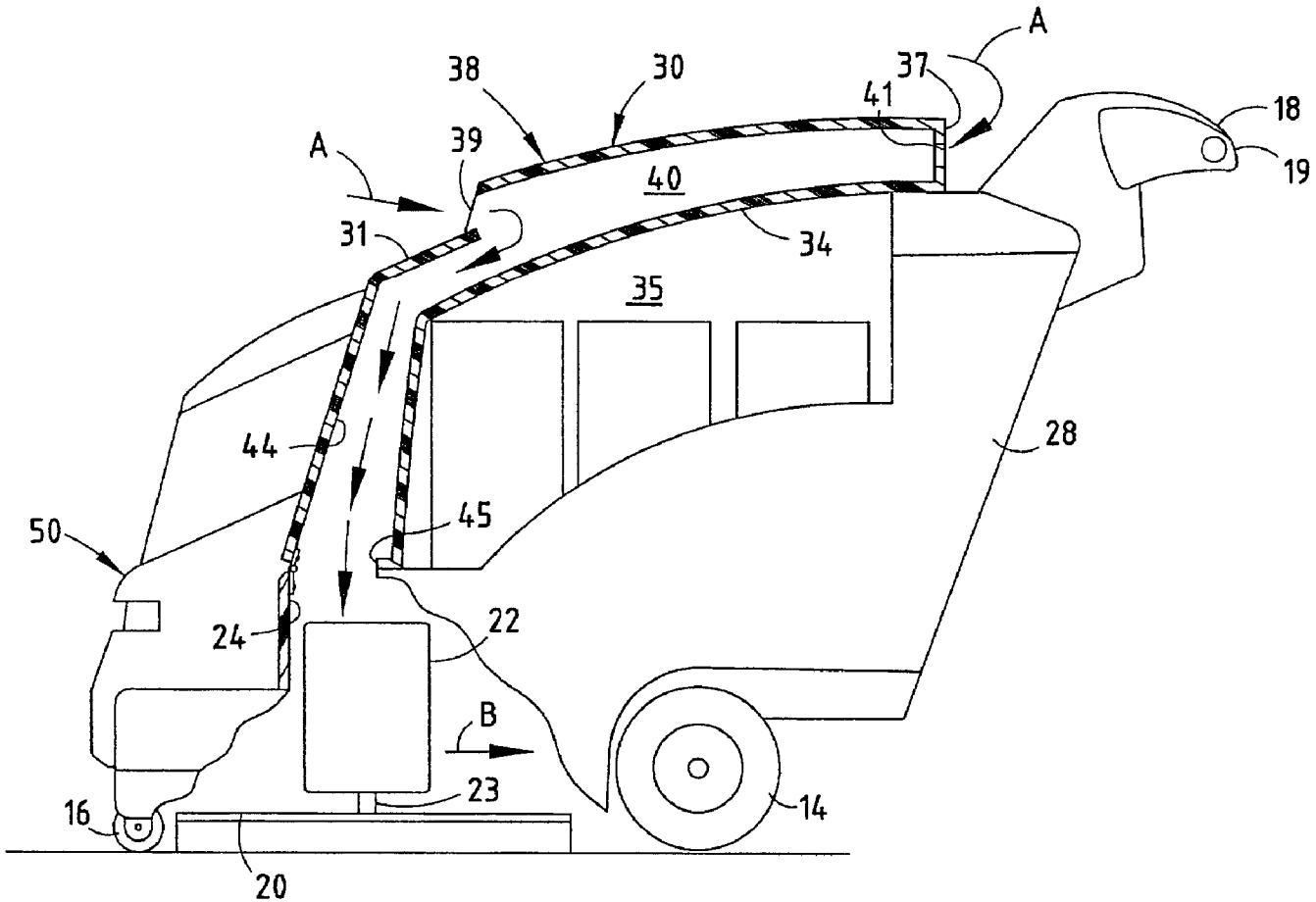
FIG. 3 is a left side elevational view, partly in vertical cross section and partly broken away, of the machine shown in FIGS. 1 and 2.
Figure 4:
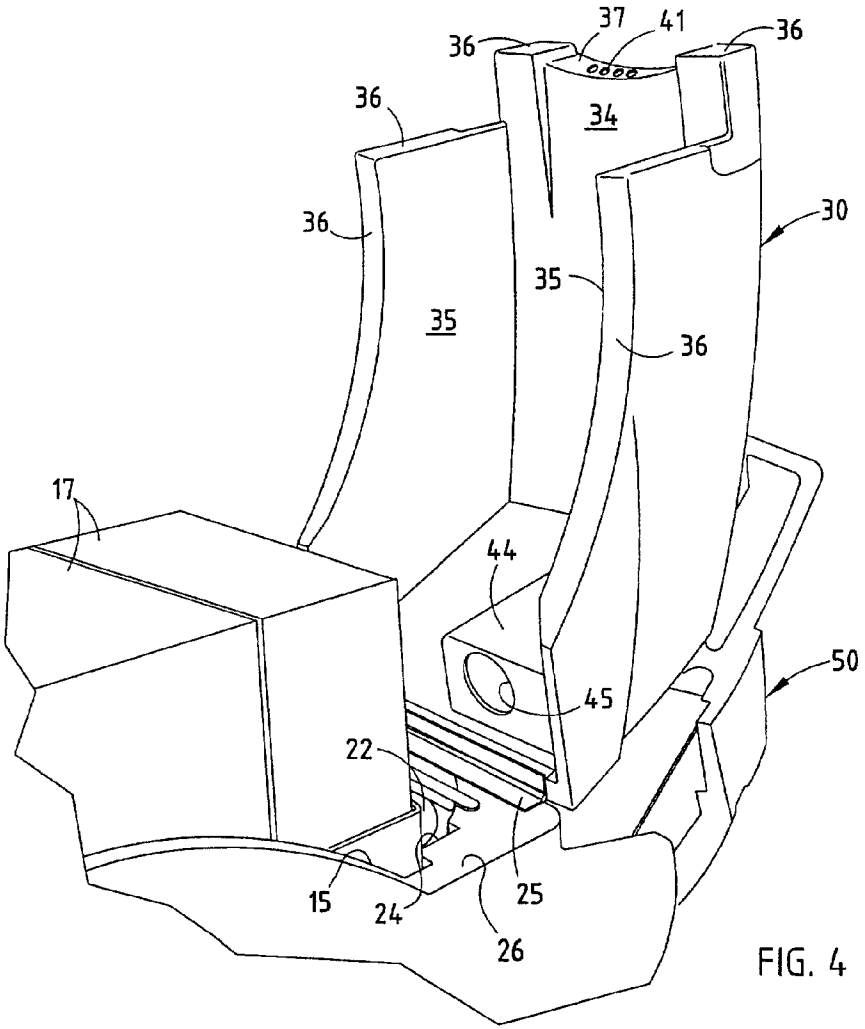
FIG. 4 is a fragmentary right rear perspective view of the machine shown in FIGS. 1–3, shown with the integral hood plenum in an open position.
Figure 6:
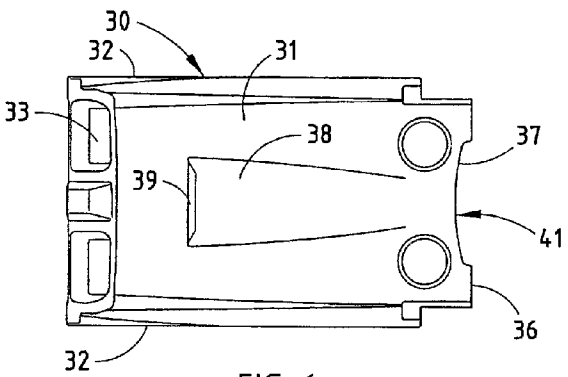
FIG. 6 is a top plan view of the hood.

The motor recess 24 is sufficiently large to provide an annular space to allow air circulation around motor 22, which has a drive shaft 23 which engages burnishing disk 20 to which a burnishing pad is mounted for rotation and engagement with the floor being treated under the control of the operator through panel 18. The battery compartment 15 and motor recess 24 are covered by the hood 30 of the present invention, which is hingedly mounted by a hinge 25 at the front of the motor compartment 26, as best seen in FIG. 4. Hingedly positioned in front of hood 30 is a cover 50 for a dust collection bag 52 (FIG. 2) located in the forward compartment 54. Cover 50 is also hingedly mounted, as seen in FIG. 4, to the front edge 53 of machine 10. Hood 30 and cover 50 are, of course, in a closed position, as seen in FIGS. 1 and 3, during use of the machine.

Figure 7:
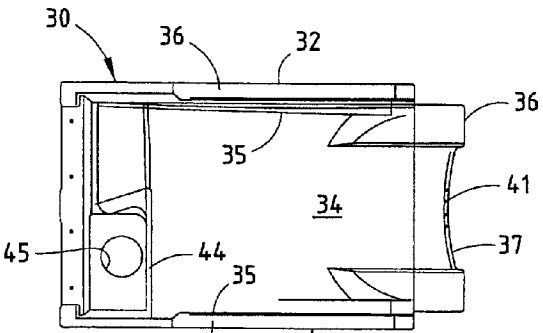
FIG. 7 is a bottom plan view of the hood.

Hood 30 embodying the present invention defines a hollow plenum 40 (FIG. 3) and is rotary molded to integrally include an upper or top wall 31, outer side walls 32, front wall 33, an inner upper wall 34 (FIGS. 3, 4, and 7), inner side walls 35 spaced from top wall 31 and outer side walls 32, respectively, by edges 36 surrounding the plenum defining hood. The top wall 31 of hood 30 includes an integral forwardly facing air scoop 38 having an air inlet grill 39 at the forward edge thereof for admitting air, as seen in FIG. 3, into the plenum chamber 40 defined by the inner and outer walls of hood 30. The upper rear wall 37 (FIGS. 4 and 8) of hood 30 also includes a plurality of vents 41 communicating with plenum chamber 40, as seen in FIG. 3, for allowing the entry of clean air, indicated by arrows A, into the upper section of plenum 40. Plenum 40 includes, as seen in FIGS. 3, 4 and 7, a downwardly extending enlarged duct 44 having a downwardly facing opening 45 defining a discharge outlet which is aligned directly above recess 24 and motor 22 therein, as best seen in FIG. 3. Air is admitted into plenum 40 and flows downwardly, as shown by arrows A in FIG. 3. The cooling air then exhausts around the motor 22 and rearwardly through the open chassis, as shown by arrow B in FIG. 3.

Figure 8:
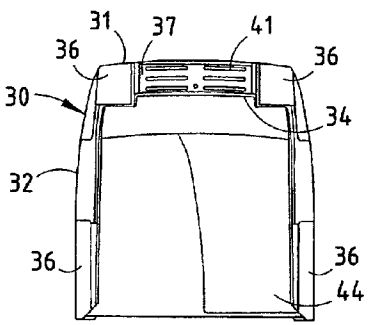
FIG. 8 is a rear elevational view of the hood.
Figure 5:
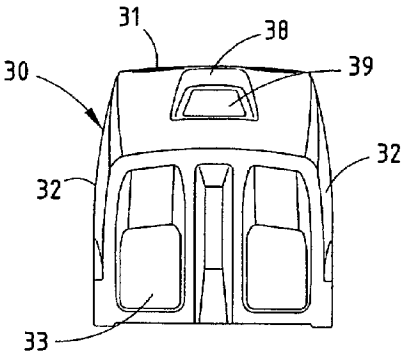
FIG. 5 is a front elevational view of the hood for the burnishing machine.

Hood 30 is rotary molded of a suitable polymeric material, such as polyethylene, having a thickness which provides structural integrity for the member, the details of which are also shown in the views of FIGS. 5–8 for the particular machine as shown in FIG. 1. Naturally, depending upon the machine shape, the hood can take on a variety of forms. It is desirable, however, that the hood define a hollow plenum with at least one air inlet, such as inlet 39, spaced above the floor, where debris from burnishing drive disk 20 is present, and has a discharge outlet within the machine and above the burnishing motor, such as outlet 45. In the embodiment shown, the inner and outer side walls and upper and lower top walls of hood 30 were spaced apart approximately 2" to 4" to define a significant plenum volume with the larger rectangular duct 44 having an opening of approximately 6"×8" to provide a 3.38" diameter opening 45 for the flow of clean, cooling air through the plenum 40 onto burnishing motor 22. Depending upon the size of the machine, the shape of hood 30 will vary to conform to the machine with which it is employed. Also, the size and shape of the plenum chamber can be varied significantly, as long as sufficient air flow is provided to provide cooling air drawn to motor 22 by its internal cooling fan and assisted by the forward motion of the machine 10 through utilization of air scoop 38. The supplemental air inlets 41 can be positioned unobtrusively in the rear wall 37, as best seen in FIGS. 4 and 8, for providing additional air inlets to the plenum chamber 40.

It will become apparent to those skilled in the art that various modifications to the preferred embodiment of the invention as described herein can be made without departing from the spirit or scope of the invention as defined by the appended claims.

The invention claimed is:

1. A floor treating machine comprising:

a drive motor for actuating a floor treating member; and a hood defining a hollow plenum, said hood extending above said drive motor for covering said drive motor and including a forward facing inlet air scoop at a position above said drive motor and remote from said floor treating member to draw clean air therein, said hood including an air outlet aligned with said motor for discharging clean, cooling air downwardly adjacent said motor.

2. The machine as defined in claim 1 wherein said plenum includes an additional air inlet positioned above and remote from said floor treating member and positioned in spaced relationship to said air scoop.

3. The machine as defined in claim 2 wherein said hood is integrally molded of a polymeric material.

4. The machine as defined in claim 3 wherein said hood is rotary molded.

5. The machine as defined in claim 1 wherein said plenum includes generally horizontally and generally vertically extending chambers defined by spaced inner and outer walls and wherein said horizontally extending chamber is located above said drive motor.

6. A burnishing machine comprising:

a motor compartment having a recess for receiving an electric motor therein;

a hood extending above and covering said motor compartment, said hood including integral spaced-apart inner and outer walls defining a plenum having a forward facing inlet air scoop at an upper end thereof and an air outlet positioned below said inlet air scoop and aligned with said recess of said motor compartment; and an electric motor positioned in said recess for receiving cooling air flowing through said plenum and discharged downwardly from said air outlet.

7. The machine as defined in claim 6 and further including an additional air inlet spaced from said air scoop.

8. The machine as defined in claim 7 wherein said plenum includes generally horizontally and generally vertically extending chambers defined by said spaced-apart inner and outer walls.

9. The machine as defined in claim 8 wherein said hood is integrally molded of a polymeric material.

10. The machine as defined in claim 9 wherein said hood is rotary molded of polyethylene.

11. A battery-powered floor treating machine comprising:

an integrally molded battery rack and motor compartment having a recess for receiving an electric motor therein;

a hood extending above and covering said motor compartment, said hood including integral spaced-apart inner and outer walls defining a plenum having a forward facing inlet air scoop at an upper end thereof and an air outlet positioned below said inlet air scoop for directing air downwardly toward said recess of said motor compartment; and a DC electric motor positioned in said recess for receiving cooling air flowing through said plenum and discharged from said air outlet.

12. The machine as defined in claim 11 wherein said plenum includes generally horizontally and generally vertically extending chambers defined by said spaced-apart inner and outer walls.

13. The machine as defined in claim 12 wherein said plenum includes an additional air inlet spaced from said inlet air scoop.

14. The machine as defined in claim 13 wherein said hood is integrally molded of a polymeric material.

15. The machine as defined in claim 14 wherein said hood is rotary molded.

16. The machine as defined in claim 15 wherein said hood is molded of polyethylene.

17. The machine as defined in claim 11 wherein said hood is rotary molded of polypropylene.

* * * * *